United States Patent [19]

Mitzel

[11] 4,260,146

[45] Apr. 7, 1981

[54] PROCESS AND APPARATUS FOR SEPARATING FLAT SHEET MATERIAL

[75] Inventor: Wilhelm Mitzel, Neukeferloh, Fed. Rep. of Germany

[73] Assignee: G.A.O. Gesellschaft fur Automation und Organisation mbH, Munich, Fed. Rep. of Germany

[21] Appl. No.: 50,975

[22] Filed: Jun. 22, 1979

[30] Foreign Application Priority Data

Feb. 12, 1979 [DE] Fed. Rep. of Germany ..... 2905278

[51] Int. Cl.[3] ..... B65H 3/10

[52] U.S. Cl. ..... 271/94; 221/211; 271/276

[58] Field of Search ..... 271/94, 95, 96, 276, 271/196, 194, 5, 195, 197, 30 A, 11-15, 34, 35, 99, 108; 414/121, 128, 72, 73; 221/211; 198/689

[56] References Cited

U.S. PATENT DOCUMENTS

| | | | |
|---|---|---|---|
| 3,185,284 | 5/1965 | Molins | 198/689 X |
| 3,390,876 | 7/1968 | Clem | 271/96 |
| 3,961,784 | 6/1976 | Sevak et al. | 271/94 |
| 3,976,291 | 8/1976 | Bernardi et al. | 271/94 |

*Primary Examiner*—Bruce H. Stoner, Jr.

*Attorney, Agent, or Firm*—Andrus, Sceales, Starke & Sawall

[57] ABSTRACT

Flat material sheets are separated by a separating drum rotating on a supporting plate that pulls the sheets separately one after another off a pile and directs the separated sheets toward a subsequent transporting system. The separating drum comprises a stator with sectorial suction channels extending circumferentially and a rotor with suction openings communicating with the suction channels. The communication between the suction openings and suction channels is made in such a way that the sheet material adjacent to the edge running on the supporting plate is attached to the drum by the action of the vacuum earlier than in other areas. This area may be released later than the other areas.

6 Claims, 5 Drawing Figures

FIG. 3
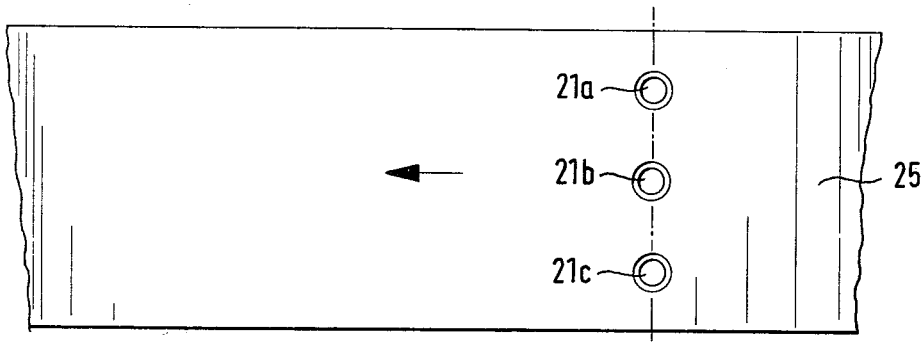
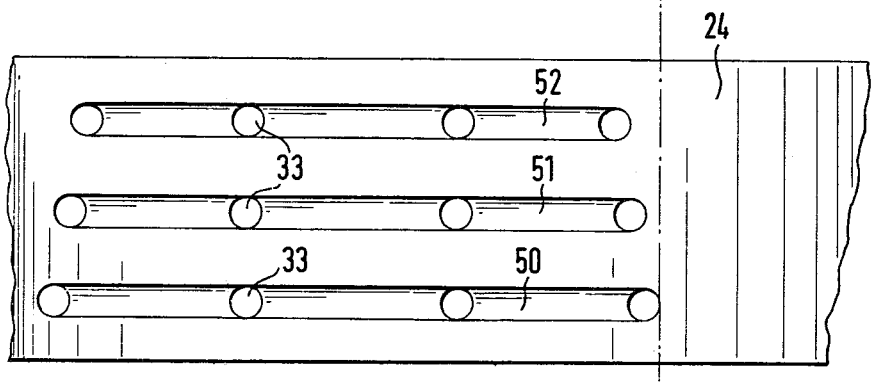
FIG. 4
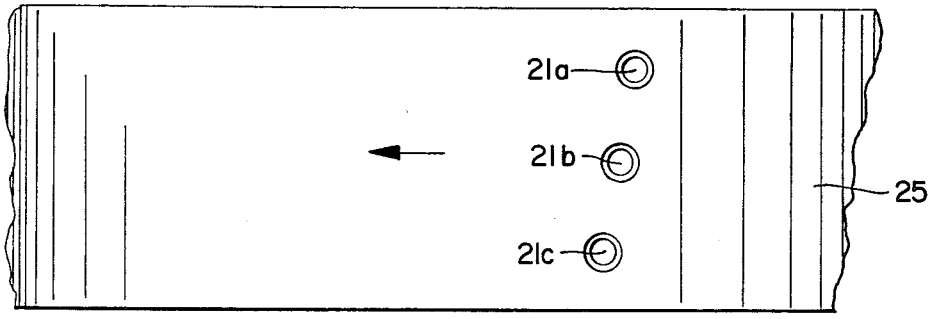
FIG. 5

PROCESS AND APPARATUS FOR SEPARATING FLAT SHEET MATERIAL

BACKGROUND OF THE INVENTION

The invention relates to a process and an apparatus for separating flat sheet material with a separating drum, turning on a lower plate, and is made up of a stator with sectorial spaces and a rotor with suction openings, used for pulling the furthest-forward piece of material to be transported from a stack of it and running it to a transport system.

In the present case "flat sheet material" is to be taken to be, more specially, banknotes, bankpapers, data and other records and pages of paper with printed material or handwriting.

An account of a process and an apparatus on these lines is given in the German Offenlegungsschrift specification No. 2,545,082. With this old separating apparatus it is possible for flat data material to be taken from a stack at a high speed separately and guided into a transport system.

However, in this old separating apparatus, it is frequently possible for a single piece of sheet material to be pushed into a sloping position by the separating drum and, generally, the back part of the sheet material is worked upwards. Such a sloping position of the material with its back end at a higher level is undesired with respect to the necessary running of the sheet of material into further parts of the system for further processing steps.

SUMMARY OF THE PRESENT INVENTION

One purpose of the present invention is that of designing a process and an apparatus for separating flat sheet material in the case of which any sloping of the separate sheets so as to be in a lifted position is stopped.

For effecting these and other purposes the design of the invention is such that the lower suction openings near the lower plate of the separating drum are joined with vacuum for a greater sectorial range than the other suction openings.

In a preferred form of the invention the length, measured in the peripheral direction, of the suction spaces becomes greater from the lowermost suction space to the topmost one at the two ends of the spaces.

In the German Offenlegungsschrift specification No. 2,454,082, there is a detailed account of a separating unit which is taken as a starting point in the development of the present invention. The account of this German specification is to be noted in connection with the present invention.

The old apparatus has a separating drum, which is generally made up of a stator with sectorial suction spaces and a rotor, placed round it, with suction openings. The separating drum and the stator take the form of a turning valve. The suction openings are placed along a line on the outer face of the casing parallel to the axis of the cylindrical rotor and are joined with vacuum at the same time.

It has, however, turned out that when separating is being undertaken, it may be that the sheet material is vacuum-gripped near the top edge, and moved by the separating drum round its axis, while the suction-gripping near the lower edge takes place later in time, this being the cause of a turning force on the sheet material making it go into a sloping position, in which part of it is at a higher level, with the back end of the sheet material lifted clear of the lower plate.

Seemingly this lifting of the sheet material is caused by different effects. Because the sheet material is moved towards the separating drum in an undesired way or because the sheet material is not completely flat, for example because of a dog's ear, it may be that the distance between the sheet material and the separating drum near the top edge and the lower edge is different. If the distance at the top edge of the sheet is smaller, then the sheet will be suction-gripped at the top beforehand, so that, as has been noted, a turning force will be produced, and the back end of the sheet material is lifted upwards. In a case in which the conditions are the other way round, no sloping position will be likely, because a pushing downwards of the trailing edge is not possible, because this edge is resting on the lower plate.

A further reason for a sloping position may be that the top edge, unlike the lower edge, is not supported. A further cause may be that the lower edge, resting on the lower plate, goes up against the separating drum later. than the top edge because of the friction acting at the time of suction-gripping, between the lower edge and the lower plate.

A further cause may be that at the time of suction-gripping the motion of air near the lower edge of the sheet is changed or stopped because of the lower plate present at this position, that is to say on suction-gripping the air between the sheet and the separating drum near the lower edge of the material may not be so readily cleared as at the top edge of the sheet, and, furthermore, near the lower edge on the side facing away from the separating drum, of the sheet the air is less readily moved by the suction effect. An opposite vacuum, produced for this reason, would as well have an effect slowing down the suction-gripping operation at the lower part of the sheet to be transported.

In the invention the suction openings placed in the lower part of the lower plate are joined with suction air over a greater sectorial range than the other suction openings. Because of this, the suction openings are not put into operation at the same time but in a timed order.

If for example there are three suction openings, firstly the lowermost one then the middle one and lastly the topmost suction opening will be put into operation. Because the suction openings are put into operation at different times, a moment of force comes into play on the sheet material for overcoming any tendency of the back end of the sheet material to be lifted upwards. Because of this, the transported sheets, which would go into a sloping position on the suction-gripping operation because of one or more of the conditions and forces noted, may be kept in the desired position and run on to the next transport system.

Furthermore a good effect may be produced by so designing the suction spaces of the stator that the lowermost suction opening is kept in operation for the longest time, while the topmost suction opening is stopped earliest. This shutting off of the suction openings in a timed order as well has a righting effect on the sheets stopping any lifting up of the trailing edge of the sheets.

In a preferred form of the invention, the sectorial suction spaces of the stator have different peripheral lengths, the peripheral length of the suction space acting at a position near the lower edge of the sheet being greatest while the peripheral length of the suction space acting near the top edge of the transported sheet is smallest.

The selection of the degree to which the peripheral lengths of the lowermost suction space and of the topmost suction space are different is dependent on a number of design conditions, more specially on the geometry of the parts used and on the speed of operation. The degree to which the suction spaces are out of line does not have to be the same at the start and the end of the suction operation. Because at the end of the suction operation there is no shortcoming caused by inlet of air, the degree of being out of line may be made smaller here or the suction spaces may not be out of line at all.

BRIEF DESCRIPTION OF THE DRAWING

An account of a preferred working example of the invention using the figures will now be given.

FIG. 3 is a development of the outer face of the rotor.

FIG. 4 is a development of the outer face of the stator.

FIG. 5 is a development of the outer face of an alternative embodiment of the rotor.

DETAILED DESCRIPTION OF THE PREFERRED EMBODIMENT

Figure 1:
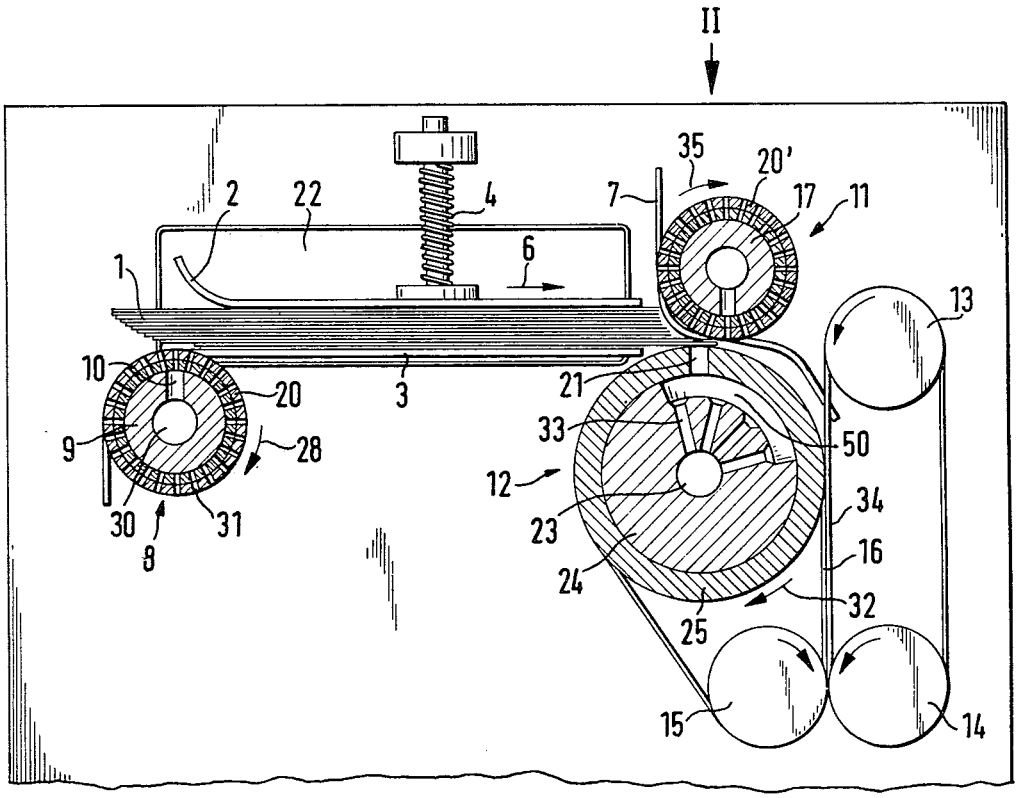
FIG. 1 is a diagrammatic plan-view and part-section of a separating unit.

In FIG. 1 a separating unit is to be seen diagrammatically taking the form of one working example of the invention, without, however, any parts not needed for the account of the invention. In this separating unit the sheet material to be processed is upright or on edge, although a system with the material horizontal would be possible as well.

The stack 1 of sheet material is kept in the form of a parcel on the input plate 3 by way of a spring 4 and a weighting plate 2.

The lower plate 22 may be joined with a shaker (not figured) by which the sheet material is moved in the direction of the arrow 6 till it comes up against the keeper comb 7.

The forwarding drum 8 is designed as a suction drum turning in the direction of the arrow 28. By way of suction airways 30 and 10, placed in the stator 9, the suction openings 31 of the rotor 20 are joined with vacuum.

The keeping back drum 11 is the same in design as the forwarding drum 8 and is turned in the direction of arrow 35. It is made up of a stator 17 and a rotor 20.

The sheet material is guided through the narrow gap between the keeping back drum 11 and the separating drum 12 to a transport system, which takes the form of belts 16 and 34 together with driving rollers 13, 14 and 15, or pulleys.

The separating drum 12, turned in the direction of arrow 32, is made up of the stator 24 and the rotor 25. In the stator, sectorial suction spaces 50 are present, joined by way of radial airways 33 and a central airway 23 with a vacuum system (not figured). In the rotor 25 suction openings 21 are present, placed along a line parallel to the rotor axis. The stator 24 with the suction spaces 50 forms one part of a valve, whose other part is formed by the rotor 25 with its suction openings 21.

Figure 2:
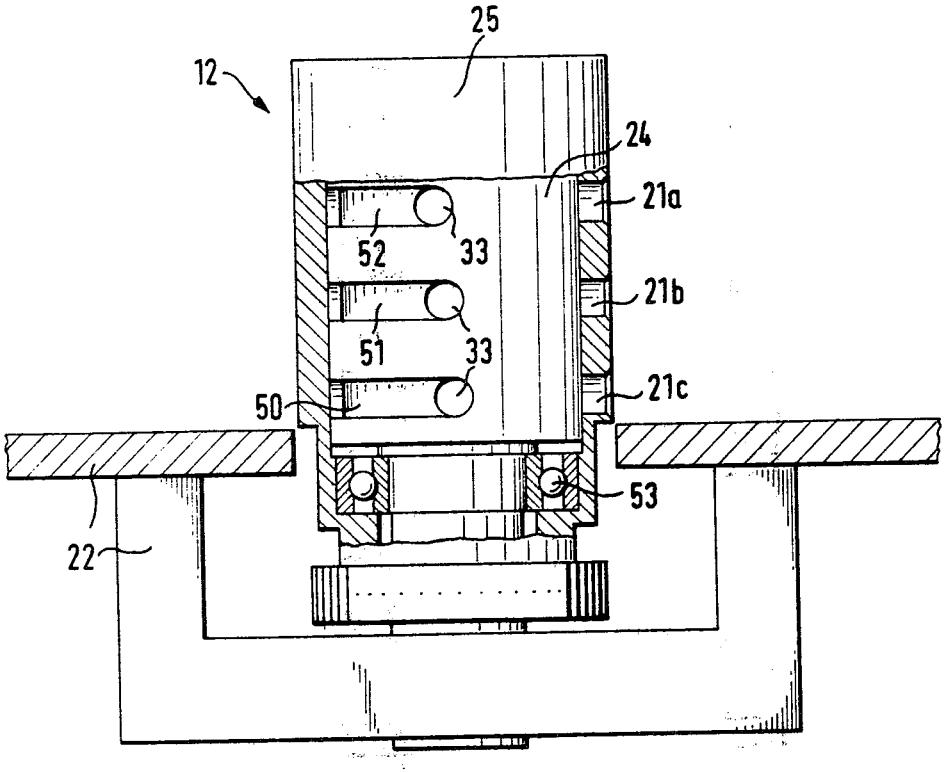
FIG. 2 is a view of a separating drum, the rotor being in section and the stator in plan-view.

In FIG. 2 the separating drum 12 is to be seen looking in the direction of the arrow marked in FIG. 1. The rotor 25 is sectioned. In the stator 24, which is fixed on the lower plate 22, the sectorial suction spaces 50, 51 and 52 are formed stretching in the peripheral direction. They are joined by way of radial airways 33 with a vacuum pump.

The rotor 25 is joined with the stator 24 by ball bearings 53 and has three suction openings 21 *a*, *b* and *c*, along a line on its outer surface parallel to its axis.

At the point in time at which the sheets are separated, the suction openings 21 *a*, *b* and *c* are being moved over the suction spaces 50, 51 and 52 and, for this reason, are joined with the vacuum by way of the spaces. As will now be seen from FIG. 2, the suction spaces 50, 51 and 52 of the stator are so placed one above the other out of line that when the drum is turned in the separating stage firstly the lowermost suction opening 21 *a* is joined with its suction space 50.

Then, on the drum being further turned, nextly the middle suction opening 21 *b* and lastly the top suction opening 21 *c* is joined with its suction space 51 and, in the second case, 52. The force acting on the sheet and having the tendency of turning it with the drum firstly comes into play, for this reason, at the lower part of the leading edge of the material, so that any lifting upwards of the lower edge is stopped in any case.

The out-of-line design of the suction spaces in relation to each other is dependent on the engineering of the separating unit in question, it being generally necessary to take into account the angular speed of the suction openings and the effect of the vacuum at the suction openings.

As noted earlier, it is furthermore possible for the suction openings to be cut off in a timed order at the time at which the sheet is handed over to the next transport system. To make this clear, a development of the outer face of the rotor 25 with the suction openings 21 *a*, *b* and *c* is to be seen, while in FIG. 4 there is a development of the outer face of the stator 24, in which the suction spaces 50, 51 and 52 are present. The suction openings are moved in the direction of the arrow over the unmoving suction spaces. The lowermost suction space 50 is designed stretching past the other suction spaces 51 and 52 at the two ends with the outcome that the lowermost suction opening 21 *c* is the first one to be joined with the vacuum (as seen earlier) and is the last to be cut off from the vacuum. The other suction openings are, in this system of the suction spaces, turned on later and turned off earlier. For this reason, not only in the stage of sheet takeup, but furthermore in the stage of freeing the sheet, a moment of force is produced acting against any tendency for the back or trailing edge of the sheet to be lifted.

In a further form of the invention shown in FIG. 5 it is furthermore possible for the suction openings of the separating drum to be placed out of line with each other, and then in this case the suction spaces of the rotor are started unlike the form of the invention noted. Because of the out-of-line placing of the suction openings in this case as well, the first suction opening 21 *c* is joined with vacuum before the others. The out-of-line placing of the suction openings has, however, the shortcoming that the upright leading edge of the sheet material will be sticking out past the top suction opening, 21 *a* so that in certain cases, on handling over the sheet to the next part of the transport system, it will be responsible for the leading edge being bent round or crumpled, more specially if the material is soft or limp.

In a working example of the invention the outer diameter of the separating drum may be 80 cm. The drum may be turned at speeds between 5 and 40 rps. Normally the vacuum has a value of 6 bar. The suction airways 50, 51 and 52 (see FIG. 2) are best placed out of line by about 1 to 5 mm, and more specially 2 to 3 mm.

If the suction spaces are out of line not only at the start, but furthermore at the end, the peripheral lengths of the lowest suction space 50 and of the topmost suction space 52 will be different by about 4 to 20 mm and more specially by 8 to 12 mm.

I claim:

1. Apparatus for separating and advancing sheets of material from a stack thereof, said apparatus including a separating drum extending from a plate on which the stack rests in an edge-wise position, said separating drum having a stator containing a plurality of axially spaced suction channels extending along a portion of the periphery thereof, and said separating drum having a rotor mounted on the exterior of said stator for contacting the sheets of material to be separated, said rotor having a plurality of suction openings each of which communicates with a selected one of said suction channels as said rotor rotates about an axis normal to said plate so that the sheets sequentially adhere to said rotor and are separated and advanced from the stack, the peripheral length of said suction channels decreasing as their spacing from the plate increases, said suction channels being arranged on the stator such that the suction opening closest to said plate communicates with its suction channel before the other suction openings when said rotor rotates.

2. The apparatus according to claim 1 wherein the suction channel closest to the mounting plate has the greatest peripheral length.

3. The apparatus according to claim 1 or 2 wherein the peripheral length of said suction channels decreases at both ends of said channels as their spacing from the plate increases.

4. Apparatus for separating the advancing sheets of material from a stack thereof, said apparatus including a separating drum extending from a plate on which the stack rests in an edge-wise position, said separating drum having a stator containing a plurality of axially spaced suction channels extending along a portion of the periphery thereof, and said separating drum having a rotor mounted on the exterior of said stator for contacting the sheet of materials to be separated, said rotor having a plurality of suction openings each of which communicates with a selected one of said suction channels as said rotor rotates about an axis normal to the plate so that the sheets sequentially adhere to said rotor and are separated and advanced from the stack, said suction openings being axially out of alignment such that the suction opening closest to said plate communicates with its suction channel before the other suction openings when said rotor rotates.

5. Apparatus according to claim 4 wherein the suction channel closest to the mounting plate has the greatest peripheral length.

6. The apparatus according to claim 4 or 5 wherein the peripheral length of said suction channels decreases at both ends of said channels as their spacing from the plate increases.

* * * * *